United States Patent [19]

Nadherny

[11] 4,021,067

[45] May 3, 1977

[54] HATCH COVER LOCKING MECHANISM FOR COVERED HOPPER CARS

[75] Inventor: Rudolph E. Nadherny, Naperville, Ill.

[73] Assignee: Illinois Railway Equipment Company, Chicago, Ill.

[22] Filed: Mar. 15, 1976

[21] Appl. No.: 666,597

[52] U.S. Cl. ..... 292/256.5; 105/377

[51] Int. Cl.[2] ..... E05C 3/04

[58] Field of Search ..... 105/377; 292/256.5, 292/210

[56] References Cited

UNITED STATES PATENTS

| | | | |
|---|---|---|---|
| 1,204,667 | 11/1916 | King | 292/210 |
| 2,561,938 | 7/1951 | Meng et al. | 292/210 X |
| 3,804,026 | 4/1974 | McNally | 292/246 |
| 3,848,912 | 11/1974 | Jensen et al. | 292/256.5 |

*Primary Examiner*—Richard E. Moore
*Attorney, Agent, or Firm*—Lockwood, Dewey, Zickert & Alex

[57] ABSTRACT

A lock-down mechanism for a hinged hatch cover having a lock strap with an arm portion projecting laterally over a hopper car roof on the side of the hatchway opposite the hatch cover hinge. An operating lever is pivotally mounted at one end on an upstanding support on the car roof and positioned adjacent one side of the arm portion when the hatch cover is closed. A pawl is pivotally mounted on the operating lever and has a foot portion and a latching portion. The foot portion engages the top side of the press-down arm when the locking mechanism is in its closed condition with the hatch cover fully closed. The latching portion of the pawl engages a formation on the lever support when the mechanism is in locking condition, this latter engagement resulting from an over-center or toggle-like action. The pawl has an upstanding portion which may be readily engaged by a trainman's heel to rotate the pawl and thereby trip or unlatch the lock mechanism so as to free the lever for rotation to its open position allowing the hatch cover to be lifted.

9 Claims, 7 Drawing Figures

HATCH COVER LOCKING MECHANISM FOR COVERED HOPPER CARS

This invention relates to new and improved locking means particularly suited for locking hatch covers of railway hopper cars of the type having in their roofs longitudinally extending upstanding hatchways or trough hatches. Hatch cover locking means of this general type for hopper cars are disclosed in prior art patents including, Jensen and Nadherny U.S. Pat. No. 3,848,912 issued Nov. 19, 1974 and McNally Pat. No. 3,804,026 issued Apr. 16, 1974. These prior hatch cover locking means utilized elongated operating levers which were pivoted adjacent one end on a suitable support mounted on the roof structure of the hopper car. On being turned or pivoted into their locking positions the operating levers, or parts carried thereby, of these prior constructions engaged laterally projecting press-down arms or locking extensions provided by the latch straps mounted on the hinged hatch covers so as to press down on such extensions or arms and thereby secure the hatch covers in their closed or locked positions. Releaseable retention or catch means were provided in these prior structures for securing the operating handle in its closed or locked position.

The object of the present invention, generally stated, is the provision of new and improved locking means for hatch covers of hopper cars or the like having a simplified construction with fewer parts and offering advantageous operating characteristics. One of these improved operating characteristics is the positive pivoting of a pawl-type lock member into proper position during the course of turning an operating lever into its normal closed or locked condition. A second advantageous operating characteristic is the ability of the locking mechanism to be tripped or unlocked by the action of a trainman's heel on a projecting portion of the pawl or locking member. Still another operating advantage is the ability of the locking means to function even if a hatch cover is appreciably above its normal position prior to locking.

Certain other objects of the invention will become apparent to those skilled in the art from the following detailed description of a preferred embodiment thereof taken in connection with the accompanying drawings wherein.

Figure 5:
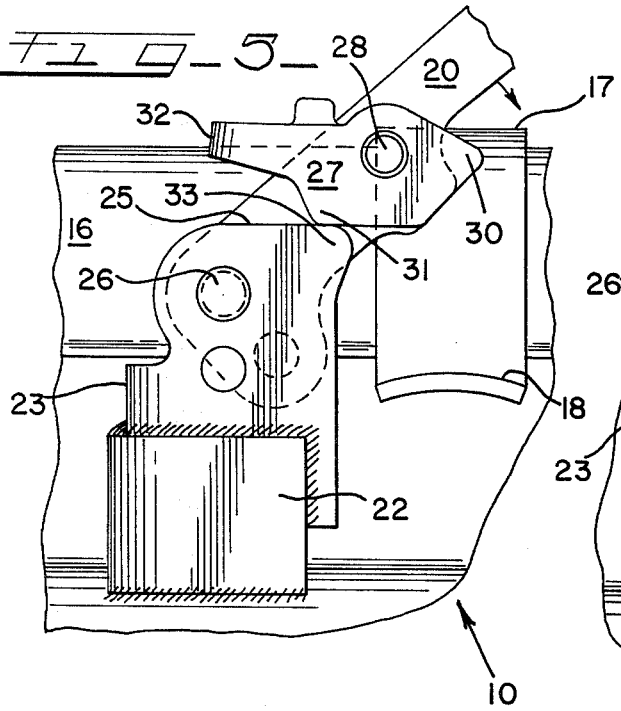
Figure 6:
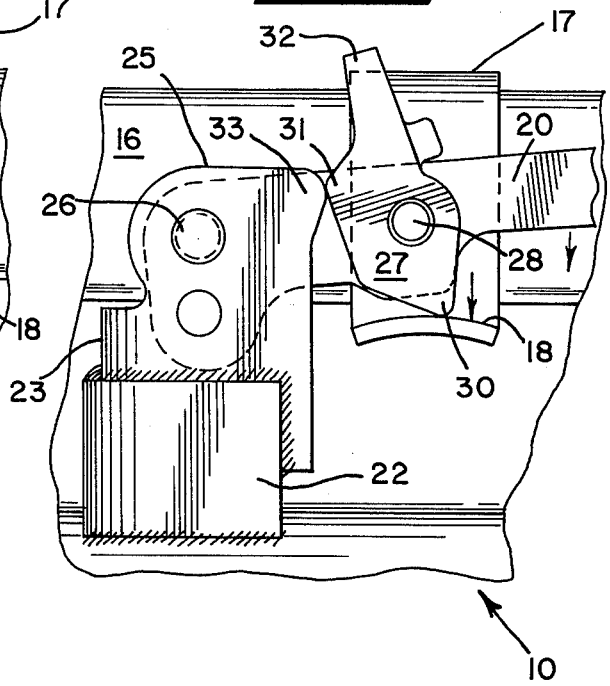
Figure 7:
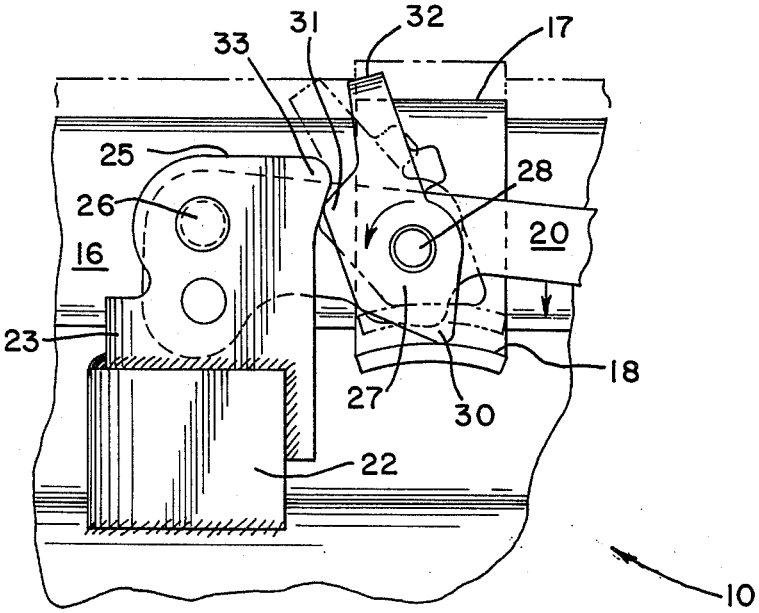

FIG 5. is a fragmentary side elevational view showing the relationship of the parts when the operating lever is in an intermediate position and being turned toward its locking position;

FIG. 6 is a fragmentary side elevational view similar to FIG. 5 but showing the parts in their relative positions when the operating lever is in position to be forced down to bring about locking of the mechanism; and FIG. 7 is a fragmentary side elevational view similar to FIGS. 5 and 6 but showing the relationship of the parts when the operating handle is in a forced-down position with the locking pawl in position to be forced by over-center or snap action into its fully locked position.

Figure 1:
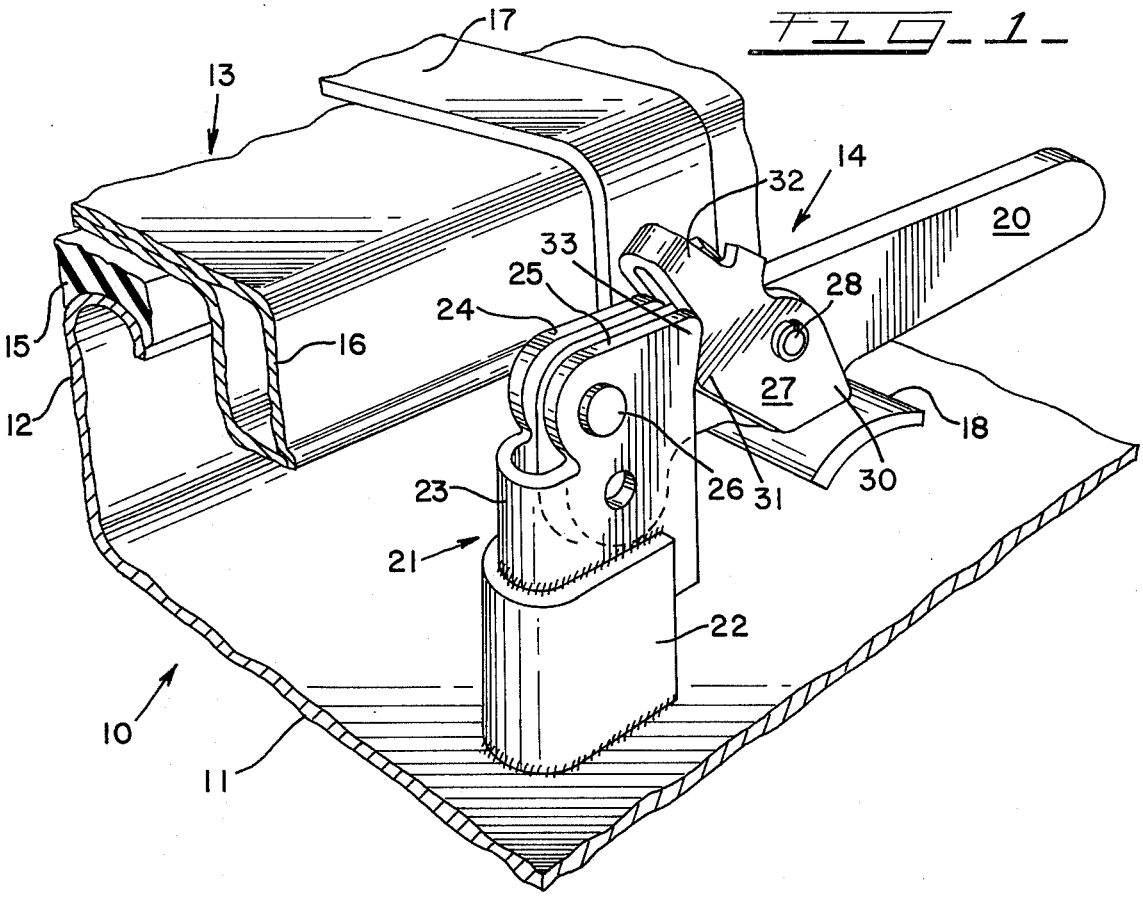
FIG. 1 is a fragmentary perspective view of a hatch cover lock-down mechanism embodying the present invention and showing the parts in the relationship which they occupy when the hatch cover is fully locked down or latched in its closed position over a hatchway or trough in the roof of a railway hopper car.
Figure 3:
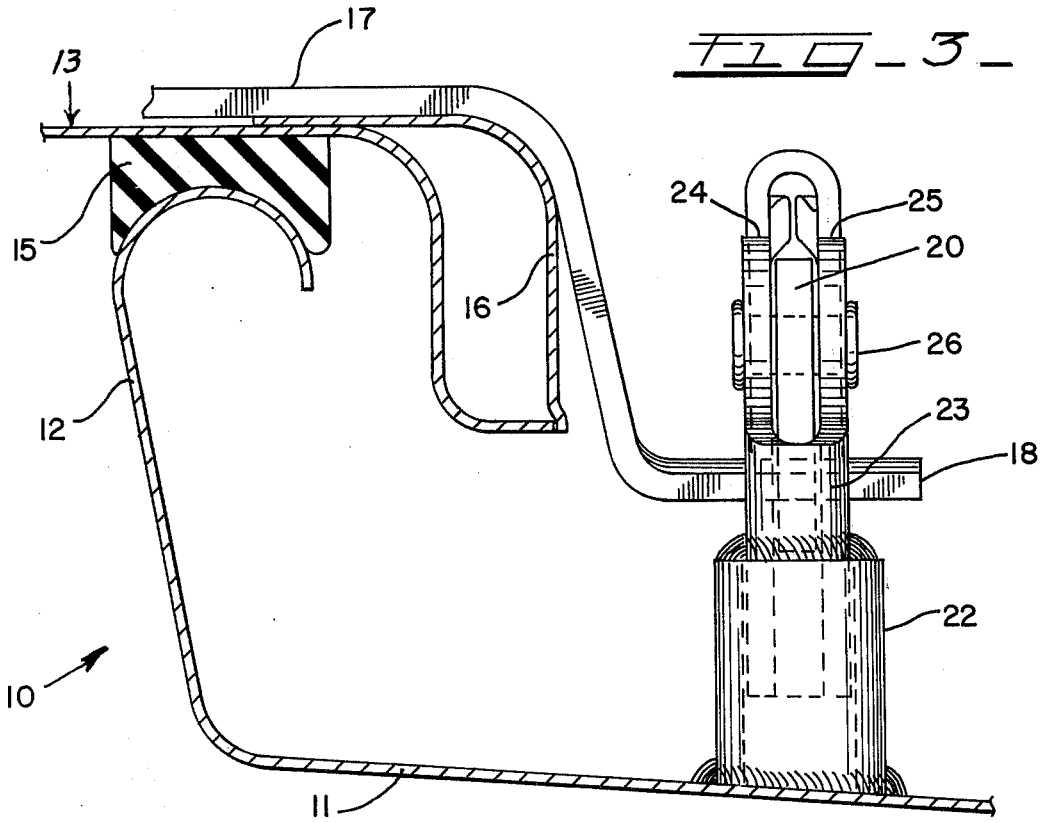
FIG. 3 is an enlarged fragmentary sectional view taken on line 3—3 of FIG. 2.

Referring to FIG. 1, the roof structure of a trough hatch hopper car is indicated generally at 10 with the roof or roof sheet being indicated at 11 and having integrally formed therewith, parallel, upstanding and longitudinally extending, coaming portions 12 (one shown) which provide the opposing sides of the upstanding hatchway or trough hatch in the roof structure 10. This roof structure including the hatchway or trough hatch is of known type as is also the hatch cover which is indicated generally at 13. The locking mechanism or assembly of the present invention for securing the hatch cover 13 in its locked down or latched condition is indicated generally at 14 on the side of the hatch cover 13 opposite from the hinged side thereof (not shown). On its underside the hatch cover 13 carries a gasket 15 formed of resilient rubber-like material of known type. In the particular construction shown, the hatch cover 13 includes a latch or locking strap support 16 longitudinally embracing the adjacent corner of the hatch cover in known manner and providing a support for a conventional latch or lock strap 17 having a laterally extending or projecting press-down arm 18.

The structure thus far described may be considered to generally follow or correspond to prior art hatch cover structures for railway hopper cars. Referring now more particularly to the details of the lock-down mechanism 14, it will be seen that it comprises an elongated operating lever or bar 20 which is pivotally mounted adjacent one end on an upstanding support structure mounted on the roof sheet 11 and indicated generally at 21. The upstanding support structure 21 comprises a U-shaped base welded or otherwise suitable secured in upstanding position on the roof sheet 11. The base 22 carries in the upper portion thereof a U-shaped or bifurcated member 23 having spaced, correspondingly shaped sides 24 and 25. The operating lever 20 is pivoted at one end on the member 23 between the sides 24 and 25 by means of a transversely extending pin 26.

Figure 2:
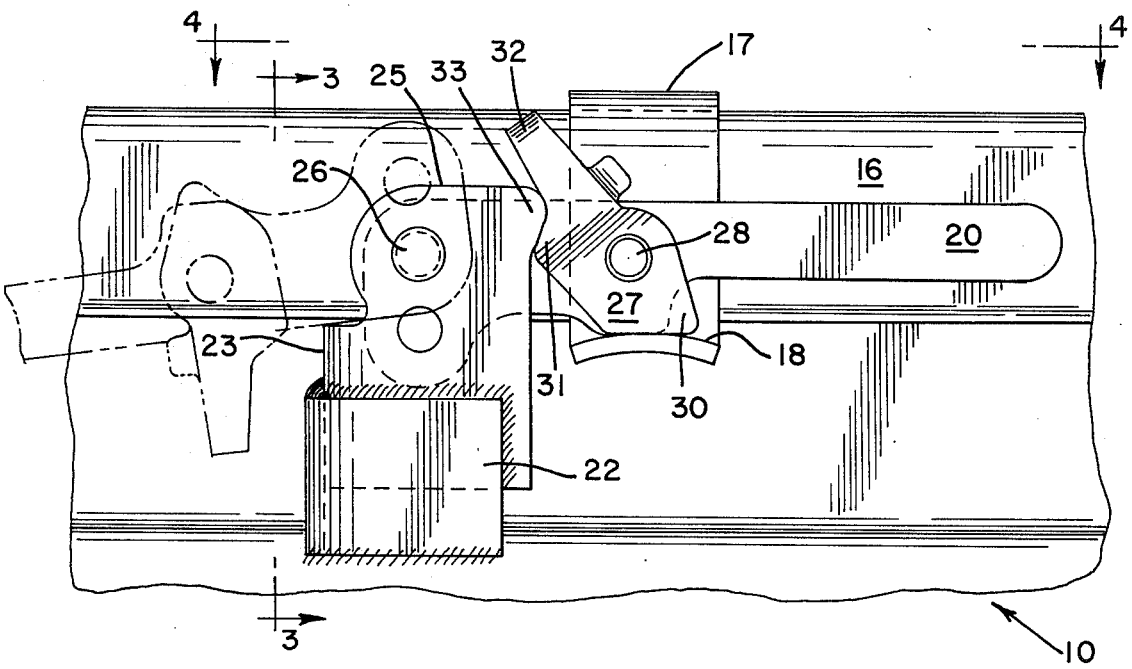
FIG. 2 is a side elevational view of the hatch cover lock mechanism as shown in FIG. 1 viewed toward the hatchway and showing the operating lever in broken line in its fully open position.
Figure 4:
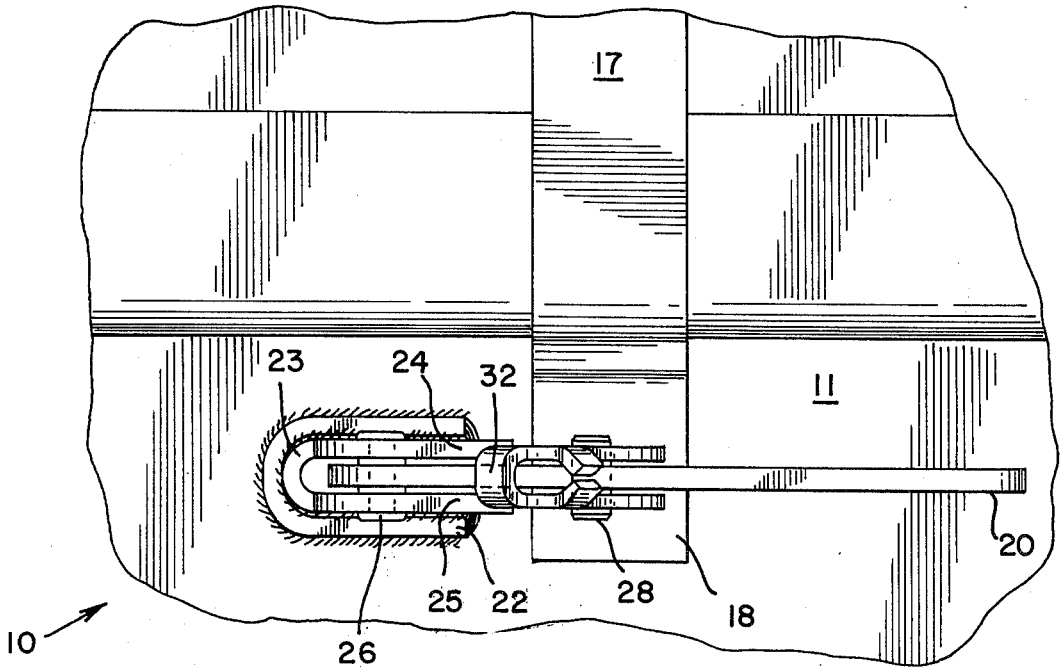
FIG. 4 is a fragmentary plan view taken on line 4—4 of FIG. 2.

In its locking position the lever 20 extends generally horizontally over the laterally projecting press-down arm 18 as shown in FIG. 2. In its unlocked and fully opened position the operating lever 20 extends generally horizontally over the roof 11 in the opposite direction as shown in broken line in FIG. 2.

The operating lever 20 has pivotally mounted thereon a pawl 27 which is U-shaped with the sides straddling the lever 20. The pawl 28 is pivotally mounted by means of a roll pin 28. The pawl 27 comprises a foot portion 30 on the lower end. This foot portion 30 is provided by the distal ends of the opposite sides of the pawl with the bottom edges adapted to have press-down bearing engagement with the top side of the laterally projecting press-down arm 18. The pawl 27 also has intermediate its opposite ends a latching formation 31 with the upper bight end 32 of the pawl providing a means whereby the mechanism 14 may be conveniently unlocked or tripped by a trainman using the heel of his shoe. The latch formation 31 on the pawl 27 is adapted to have locking engagement with the upper corner portion 33 of the support member 23 which is in the form of a rounded corner or nose projecting toward the arm 18. the interengaging or locking engagement of the pawl latching formation 33 is shown in FIG. 2.

When the lock-down or locking mechanism 14 is in the locked condition holding the hatch cover 13 in its closed condition the parts occupy the relationship as shown in FIGS. 1–4. In this condition the foot formation 30 on the pawl 27 is pressing down on the top side of the arm 18 while the latching formation 31 on the pawl is being biased or pressed into locking engagement with the retaining formation 33. This biasing action or pressing action is provided by the gasket 15 being squeezed or compressed between the hatch cover 13 and the lip of the coaming 12.

The mechanism 14 may be readily tripped or unlatched from the condition shown in FIGS. 1–4 by using the heel of a shoe or boot against the projecting end 32 of the pawl and shoving or kicking the same in a clockwise direction as viewed in FIGS. 1 and 2. This clockwise pivoting action causes the projection 31 to ride up over the corner formation 33 thereby permitting the handle 20 to be lifted and turned over approximately 180° to the broken line position shown in FIG. 2. With the handle 20 in its fully open position it will be seen that the arm 18 is free to be raised thereby permitting the hatch cover 13 to be lifted to its opened position.

When it is desired to close and lock down the hatch cover 13, it is turned down over the hatchway to the position shown in FIG. 5. The lever 30 is then lifted from the broken line position in FIG. 2 by swinging it in a clockwise direction as viewed in FIGS. 2 and 5–7. As the lever 20 is being turned, a position is reached as shown in FIG. 5 wherein the formation 31 on the pawl 27 engages the upper or top side of the nose or corner portion 33 on the support 23 thereby rotating the pawl 27 in a clockwise direction as the handle 20 is lowered in a clockwise direction. Continued movement brings the parts into the relationship shown in FIG. 6 wherein the latch formation 31 on the pawl 27 is in engagement with the rounded corner of the formation 33 and the foot formation 30 is in engagement with the top side of the arm 18. Force is now required to press down the handle 20 to its lowermost position as shown in FIG. 7 wherein the gasket 15 is compressed sufficiently to bring the parts into the position shown in FIG. 7, allowing the pawl 27 to be rotated by an over-center snap action counterclockwise into the locking position shown in broken line in FIG. 7. Upon releasing the downward pressure on the handle 30, the pawl remains in interlocking engagement with the corner portion 33 of the support 23 as shown in FIGS. 1 and 2.

What is claimed as new is:

1. Lock means for locking down in its closed position over an upstanding hatchway in a roof or deck a hatch cover which is hinged at one side of said hatchway, comprising, a hatch cover press-down member mounted on and projecting laterally from the side of said hatch cover opposite the side thereof which is hinged, said press-down member being spaced above said roof or deck when said hatch cover is closed, an upstanding support for an operating lever mounted on said roof or deck adjacent to one side of said press-down member and having a pawl-engaging formation projecting toward said press-down member, an operating lever pivotally mounted at one end on said support in such manner that in its locked position said lever extends over said press-down member, and a pawl pivotally mounted on said lever and having a foot portion for engaging said press-down member and a latching portion for engaging said pawl-engaging formation, both said foot portion being in press-down engagement with said press-down member and said latching portion being in latched engagement with said pawl-engaging portion when said lock means is in its locked condition.

2. Lock means for locking down in its closed position over an upstanding hatchway in a roof or deck a hatch cover which is hinged at one side of said hatchway, comprising a hatch cover press-down member mounted on said hatch cover and having a distal portion projecting laterally from the side of said hatch cover opposite the hinged side thereof, said distal portion being spaced above said roof or deck when said hatch cover is closed, an upstanding support for a manual operating lever mounted on said roof or deck adjacent to one side of said distal portion in its hatch cover closed position said support having a pawl-engaging formation projecting toward said distal portion, an operating lever pivotally mounted at one end on said support in such manner that in its locked position said lever extends generally horizontally over said distal portion the pivot axis of said lever being spaced further from said distal portion than said pawl-engaging formation, and a pawl pivotally mounted on said lever and having a foot portion for hold-down engagement with the top of said distal portion and a latching portion for locking engagement with said pawl-engaging formation, both said foot portion being in hold-down engagement with said distal portion and said latching portion being in locking engagement with said pawl-engaging portion when said lock means is in its hatch cover locking condition.

3. The lock means of claim 2 wherein said upstanding support for said lever has a bifurcated upper portion between the sides of which said manual operating lever is pivoted and which sides have aligned upper corner portions providing said pawl-engaging formation.

4. The lock means of claim 2 wherein said pawl-engaging formation is in the form of rounded overhanging corners.

5. The lock means of claim 2 wherein said pawl, when said lock means is in its said hatch covering locking condition, has an upper portion which extends above said lever and said support for said lever and which can be engaged to pivot and thereby trip said pawl.

6. The lock means of claim 2 wherein said pawl is U-shaped with the sides thereof straddling said lever, the distal ends of said pawl sides providing said foot portion and the aligned edges of the sides facing said lever support being shaped to provide said latching portion.

7. The lock means of claim 2 wherein upon pushing said lever into its locked position said foot portion of said pawl engages and forcibly pivots said pawl to bring said latching portion of said pawl into locking engagement with said pawl-engaging formation with a snap action.

8. The lock means of claim 7 wherein upon rotating said lever from its full open position to its locked position an intermediate portion of said pawl engages the top of said pawl-engaging formation thereby pivoting said pawl so as to bring said foot formation into engagement with said distal portion.

9. The lock means of claim 7 wherein said pressdown member is provided by a lock strap.

* * * * *